United States Patent [19]

Hamburg

[11] Patent Number: 5,054,454

[45] Date of Patent: Oct. 8, 1991

[54] FUEL VAPOR RECOVERY CONTROL SYSTEM

[75] Inventor: Douglas R. Hamburg, Birmingham, Mich.

[73] Assignee: Ford Motor Company, Dearborn, Mich.

[21] Appl. No.: 435,234

[22] Filed: Nov. 9, 1989

[51] Int. Cl.[5] ..... F02M 33/02

[52] U.S. Cl. ..... 123/520; 123/533

[58] Field of Search ..... 123/520, 519, 518, 521, 123/516, 494, 590, 533

[56] References Cited

U.S. PATENT DOCUMENTS

| | | | |
|---|---|---|---|
| 4,070,828 | 1/1978 | Barres | 123/521 |
| 4,121,549 | 10/1978 | Martin | 123/590 |
| 4,206,599 | 6/1980 | Sumiyoshi | 123/533 |
| 4,338,905 | 7/1982 | Urich | 123/518 |
| 4,465,050 | 8/1984 | Igashira | 123/533 |
| 4,519,356 | 5/1985 | Sarich | 123/533 |
| 4,530,210 | 7/1985 | Yamazaki . | |
| 4,641,623 | 2/1987 | Hamburg | 123/520 |
| 4,715,340 | 12/1987 | Cook et al. . | |
| 4,748,959 | 6/1988 | Cook | 123/520 |

*Primary Examiner*—Carl Stuart Miller

*Attorney, Agent, or Firm*—Allan J. Lippa; Peter Abolins

[57] ABSTRACT

A control system and method for an internal combustion engine and receiving inducted fuel vapors from a fuel vapor recovery system. An electronically actuated solenoid valve coupled to the fuel vapor recovery system regulates rate of vapor flow in response to the duty cycle of a desired rate of vapor flow command. The pressure differential across the valve is regulated to achieve substantially sonic vapor flow such that vapor flow is independent of engine manifold pressure fluctuations and linearly proportional to the duty cycle of the desired vapor flow command. An air/fuel ratio feedback control system is thereby able to maintain a desired air/fuel ratio during changes in inducted airflow.

18 Claims, 4 Drawing Sheets

FUEL VAPOR RECOVERY CONTROL SYSTEM

BACKGROUND OF THE INVENTION

The field of the invention relates to fuel vapor recovery systems coupled to internal combustion engines In one particular aspect, the invention relates to air/fuel ratio control for engines equipped with fuel vapor recovery systems.

Fuel vapor recovery systems are commonly employed on modern motor vehicles to reduce atmospheric emissions of hydrocarbons. Typically, a storage canister containing activated charcoal is coupled to the fuel tank for adsorbing hydrocarbons which would otherwise be emitted into the atmosphere. Such storage canisters may also be utilized to capture hydrocarbons when filing the fuel tank. To cleanse the canisters, ambient air is occasionally purged through the canister for absorbing stored hydrocarbons and inducting the purged hydrocarbon vapors into the engine. In addition, fuel vapors are inducted directly from the fuel system into the engine. The rate of vapor flow, from the both fuel system and canister, is typically controlled by pulse width modulating an electronically actuated solenoid valve.

Fuel vapor recovery systems add complications to air/fuel ratio feedback control systems. Conventional air/fuel ratio control systems regulate the induction of fuel in linear proportion to a measurement of inducted airflow for achieving a desired air/fuel ratio. Feedback control is then utilized to trim the inducted fuel charge in response to an exhaust gas oxygen sensor for maintaining the desired air/fuel ratio. When fuel vapor recovery systems are employed in vehicles having air/fuel ratio feedback control, the induction of rich fuel vapors may occasionally exceed the range of authority of the air/fuel feedback control system. Further, when vapor purge is initiated, there may be a transient in air/fuel ratio during the response time of the feedback control system.

U.S. Pat. No. 4,715,340 issued to Cook et al addresses the above problems. More specifically, the rate of vapor flow is controlled to be proportional to a calculation of inducted airflow (or, similarly, desired fuel charge calculation) such that the overall inducted mixture of air, fuel, and fuel vapor remains within the feedback system's range of authority. Air/fuel ratio transients which would otherwise occur during the onset of vapor induction are also reduced by maintaining vapor flow proportional to inducted airflow. This is accomplished by actuating the solenoid valve of the vapor recovery system with an electrical signal having a pulse width proportional to a measurement of inducted airflow.

The inventor herein has recognized at least one disadvantage of the above and similar approaches. More specifically, vapor flow through the solenoid valve is linearly proportional to the pulse width of the actuating signal only when the pressure differential across the valve is above a critical value correlated with sonic flow. Below this value, vapor flow is also a function of manifold pressure. Accordingly, vapor flow is not always linearly proportional to airflow, and accurate air/fuel ratio feedback control will not be achieved. This disadvantage becomes more pronounced with engines having low (or even positive) manifold pressures during portions of their operating cycles such as, for example, multiple intake valves per cylinder engines, supercharged engines, and turbocharged engines.

SUMMARY OF THE INVENTION

The above object is achieved, and the problems and disadvantages of prior approaches overcome, by providing a control system for an internal combustion engine having an air/fuel intake system coupled to a fuel system. In one particular aspect of the invention, the control system comprises: fuel vapor recovery means coupled to the fuel system for receiving fuel vapors; control means for providing a desired rate of vapor flow signal; an electronically actuated solenoid valve responsive to the desired rate of vapor flow signal and coupled between the fuel vapor recovery means and the air/fuel intake system for controlling actual rate of vapor flow; and regulating means for regulating pressure differential across the valve to achieve substantially sonic vapor flow through the valve such that the actual rate of vapor flow is linearly proportional to the desired rate of vapor flow signal.

An advantage of the above aspect of the invention is that substantially sonic flow through the valve is maintained such that the flow rate is substantially independent of pressure variations across the valve. Accordingly, vapor flow through the valve will be linearly proportional to the desired rate of vapor flow regardless of variations in manifold pressure.

In another aspect of the invention, the control system comprises: fuel vapor recovery means coupled to the fuel system for receiving fuel vapors; control means for providing a desired rate of vapor flow command in relation to a calculation of inducted airflow; air/fuel ratio feedback control means responsive to both the calculation of inducted airflow and feedback from an exhaust gas oxygen sensor for regulating fuel inducted into the air/fuel intake system to achieve a desired air/fuel ratio of a mixture of air and fuel and fuel vapor inducted into the air/fuel intake system; an electronically actuated solenoid valve responsive to the desired rate of vapor flow command and coupled between the fuel vapor recovery means and the air/fuel intake system for controlling actual rate of vapor flow; and regulating means for regulating pressure differential across the valve to achieve substantially sonic vapor flow through the valve such that the actual rate of vapor flow is linearly proportional to the desired rate of vapor flow command.

An advantage of the above aspect of the invention is that substantially sonic flow through the valve is maintained such that the flow rate is substantially independent of pressure variations across the valve. Accordingly, vapor flow through the valve will always be linearly proportional to the desired rate of vapor flow regardless of variations in manifold pressure. An additional advantage is thereby provided of accurate air/fuel ratio feedback control having minimal transients in air/fuel ratio during induction of fuel vapors. Further, the above aspect of the invention avoids excursions in air/fuel ratio which are beyond the range of authority of the air/fuel ratio feedback control system.

DESCRIPTION OF THE DRAWINGS

The invention claimed herein will be better understood by reading an example of an embodiment which utilizes the invention to advantage, referred to herein as the preferred embodiment, with reference to the drawings wherein:

DESCRIPTION OF THE PREFERRED EMBODIMENT

Figure 1:
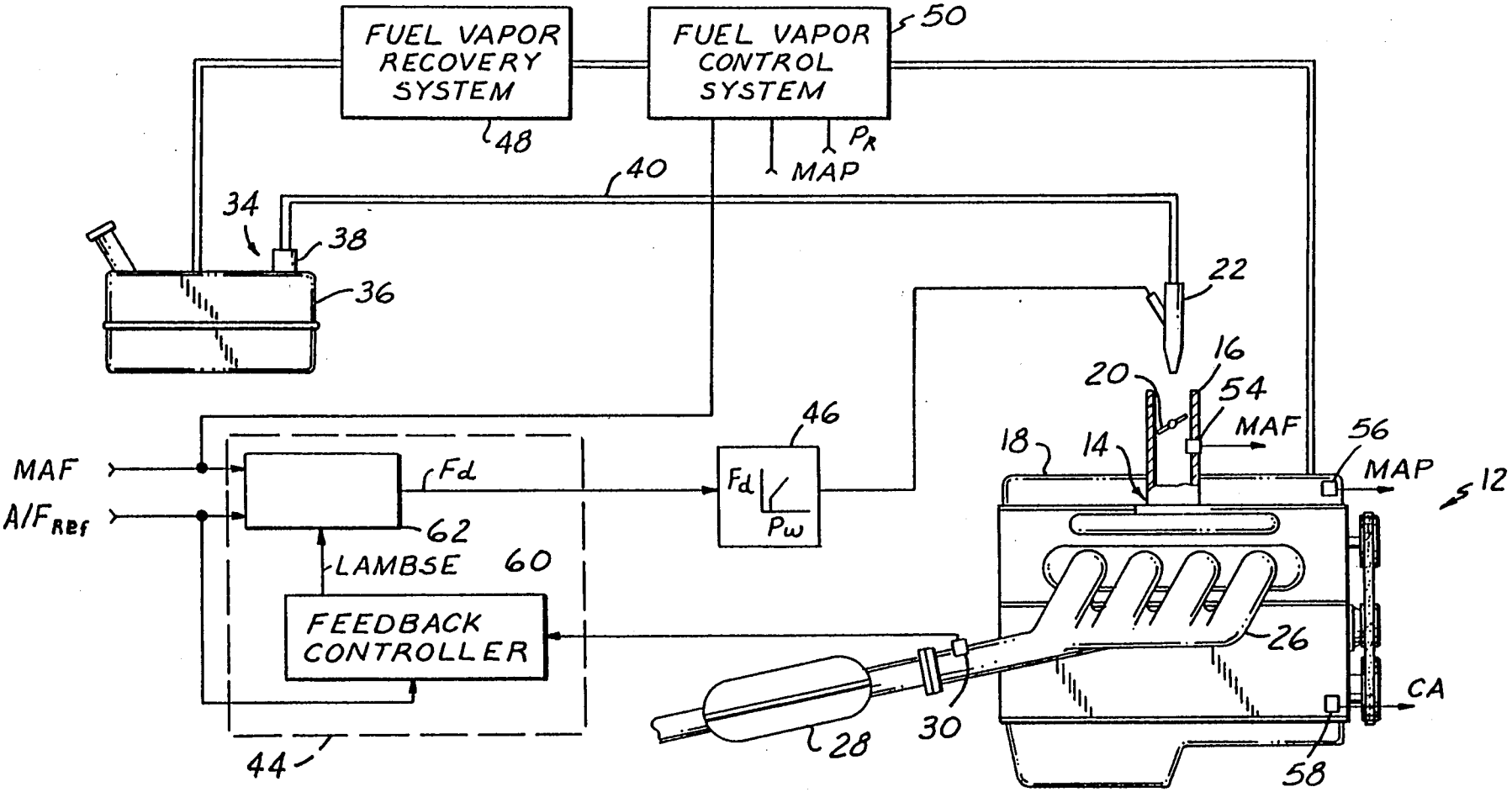
FIG. 1 is a block diagram of an engine, air/fuel ratio feedback control system, fuel vapor recovery system, and fuel vapor control system in which the invention is used to advantage.

Referring first to FIG. 1, internal combustion engine 12 is shown having air/fuel intake system 14 which includes air/fuel intake 16 coupled to intake manifold 18. Air/fuel intake 16 is shown having conventional throttle plate 20 positioned therein and is also shown receiving fuel from electronic fuel injector 22. Exhaust manifold 26 is shown coupled to conventional three-way ($NO_x$, CO, and HC) catalytic converter 28. Exhaust gas oxygen sensor (EGO) 30, a conventional two-state (rich/lean) sensor in this example, is shown coupled to exhaust manifold 26.

Fuel system 34, including fuel tank 36, fuel pump 38, and fuel line 40, is shown coupled to fuel injector 22. As described in greater detail later herein, fuel injector 22 supplies fuel in response to air/fuel ratio feedback control system 44 and fuel controller 46. Fuel vapor recovery system 48 and fuel vapor control system 50 are shown coupled to fuel system 34 for supplying fuel vapors to engine 12 as described in greater detail later herein.

Various sensors are shown coupled to engine 12 for supplying indications of engine operation. Mass airflow sensor 54 is shown coupled to air/fuel intake 16 for providing a measurement of mass airflow (MAF) inducted into engine 12. Manifold pressure sensor 56 provides a measurement of absolute manifold pressure (MAP) in intake manifold 18. Crank angle sensor 58, coupled to the engine crankshaft (not shown), provides angular position (CA) of engine 12. It is noted that these and other indications of engine operating parameters may be provided by other conventional means. For example, inducted airflow may be provided from signal MAP and engine speed by utilizing known speed density algorithms. It is further noted that various engine systems such as the ignition system have been deleted because they are not necessary for understanding the invention.

Continuing with FIG. 1, air/fuel ratio feedback control system 44 is shown including feedback controller 60 and desired fuel charge calculator 62. Feedback controller 60, a proportional integral feedback controller in this example, provides correction signal LAMBSE in response to a rich/lean indication from two-state EGO sensor 30. Fuel charge calculator 62 first divides a measurement of mass airflow (MAF) by the air/fuel reference ($A/F_{Ref}$) to generate an open loop fuel charge for approaching $A/F_{Ref}$. This value is then corrected (i.e., divided) by LAMBSE for generating a corrected desired fuel charge Fd such that the actual average air/fuel ratio among the combustion chambers is at $A/F_{Ref}$. In this particular example, $A/F_{Ref}$ is chosen as 14.7 lbs. air per lb. of fuel which is within the operating window of catalytic converter 28. Desired fuel charge signal Fd is then converted into pulse width modulated signal pw by conventional fuel controller 46 for actuating fuel injector 22. In response, fuel injector 22 provides an actual fuel delivery correlated with signal Fd.

Figure 2:
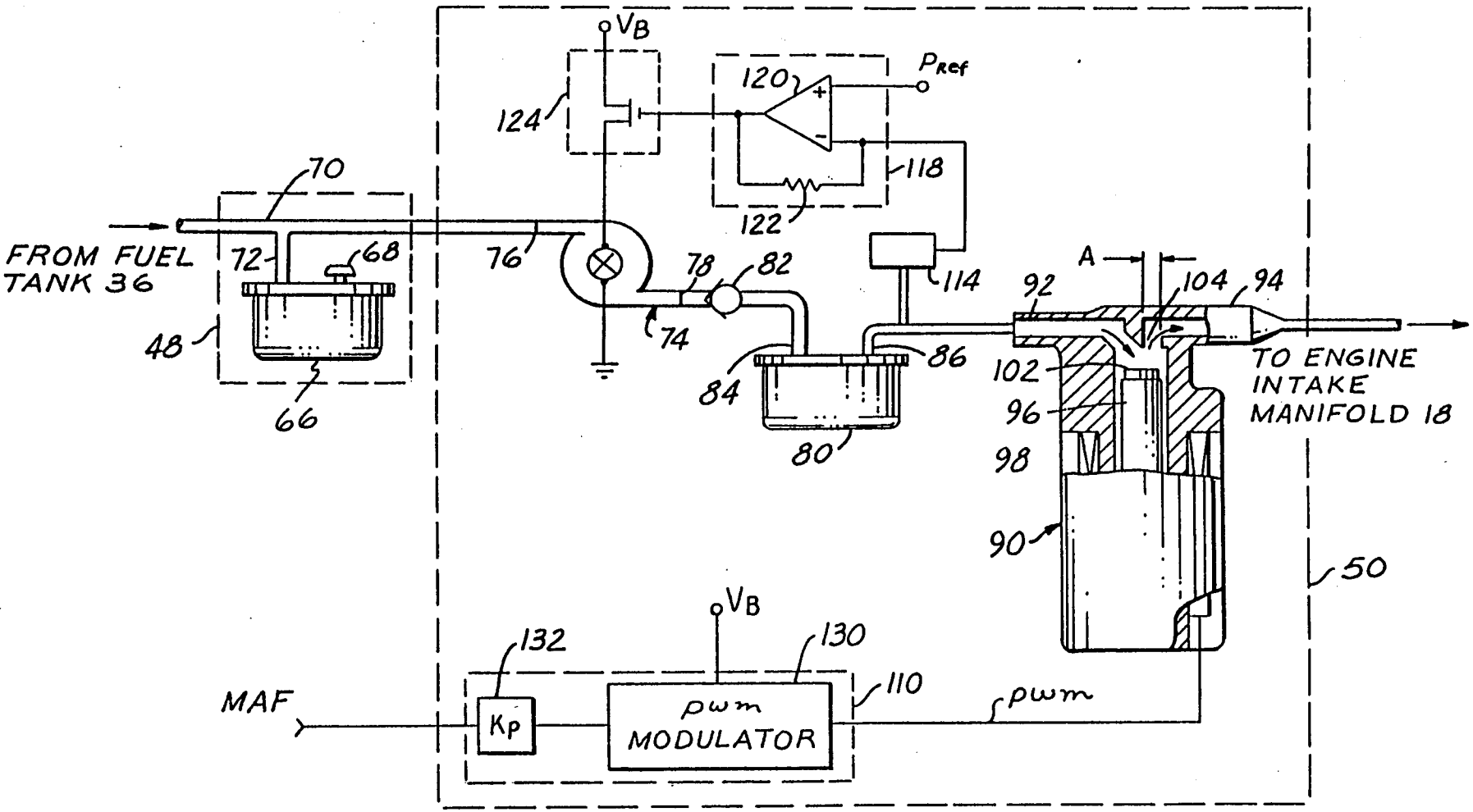
FIG. 2 is a more detailed block diagram of the fuel vapor control system and fuel vapor recovery system shown in FIG. 1.

Referring now to FIG. 2, fuel vapor recovery system 48 is shown including vapor storage canister 66, an activated charcoal canister in this example, coupled in parallel to fuel tank 36 (FIG. 1) via vapor line 70 and inlet line 72. Vapor storage canister 66 includes atmospheric vent 68. When vapor Pressure in vapor line 70 is above atmospheric pressure, vapors from fuel tank 36 flow through canister 66 where hydrocarbons are adsorbed and the remaining gaseous material is harmlessly vented through vent 68. During induction of fuel vapors into engine 12, referred to herein as vapor purging, when pressure in vapor line 70 is below atmospheric pressure, ambient air is drawn through vent 68 for absorbing stored hydrocarbons from canister 66 and inducting them into engine 12. Concurrently, fuel vapors are indicted directly from fuel tank 36 into engine 12.

Fuel vapor control system 50 is shown including centrifugal pump 74 having inlet 76 coupled to fuel vapor recovery system 48. Outlet end 78 of pump 74 is coupled to reservoir 80 via check valve 82 which is oriented such that vapor is only permitted to flow into reservoir 80. Check valve 82 leaks in the reverse direction so that vapors can slowly leak back into canister from reservoir 80, when engine 12 is not running. This prevents reservoir 80 from being at high pressure when the vehicle is not in use. Electronically actuated solenoid valve 90 is shown having inlet end 92 coupled to outlet 86 of reservoir 80 and also having outlet end 94 coupled to intake manifold 18 (FIG. 1). Solenoid valve 90 is shown having axially deflectable armature 96 responsive to electromagnetic force from coils 98. Armature 96 is shown including resilient cap 102 for sealing and unsealing orifice opening 104. In this particular example, orifice opening 104 is shown as a circular opening of cross-sectional area A. As described in greater detail later herein, coil 98 of solenoid valve 90 is actuated during the "on" phase of pulse width modulated signal pwm from purge rate controller 110. During the "on" phase signal pwm, armature 96 is fully retracted such that vapor flows through cross-sectional area A of orifice opening 104. When signal pwm is in the "off" state, armature 96 is fully closed by a return spring (not shown) thereby sealing orifice opening 104 with cap 102. Thus, solenoid valve 90, is either fully opened or fully closed in response to signal pwm. Stated another way, orifice opening 104 of solenoid valve 90 is either fully closed or fully opened to cross-sectional area A in response to signal pwm.

Continuing with fuel vapor control system 50, pressure transducer 114 is shown coupled to inlet 92 of solenoid valve 90 and outlet 86 of reservoir 80 for providing an electrical signal to comparator 118 which is linearly proportional to pressure at inlet 92. It is noted that the inlet pressure is the same as pressure in reservoir 80 which serves to average pressure fluctuation from vapor recovery system 48 and pump 74. The other input to comparator 118 is shown as electrical signal $P_{Ref}$ which is a multiple of the maximum pressure which may exist in intake manifold 18 over the entire operating cycle of engine 12. The inventor herein has utilized values varying between 1.9 maximum manifold and 2 times maximum manifold pressure. Typical values of maximum manifold pressure have been found to be 14 psi for normally aspirated engines, and 21 psi for supercharged and turbocharged engines. Comparator 118 is shown in this example as operational amplifier 20 having hysteresis resistor 122. High power switch 124, shown as an FET responsive to comparator 118 and coupled between battery voltage ($V_B$) and the motor of pump 74, provides actuation of pump 74 in response to the comparison of vapor pressure at inlet 92 of valve 90 with $P_{Ref}$. For this particular example, pump 74 is actuated when vapor pressure at inlet 92 exceeds $1.9\chi_{max}$ and is turned off when vapor pressure at inlet 92 falls below $2\chi P_{max}$.

The above described pressure regulation provides a minimal pressure at solenoid valve 90 with respect to cross-sectional area "A", thereby assuring sonic flow regardless of engine operation. Accordingly, flow rate through solenoid valve 90 is independent of pressure fluctuations in engine 12 and is only related to the "on" time of signal pwm. Stated another way, flow rate through solenoid valve 90 is linearly proportional to duty cycle of signal pwm regardless of engine operating conditions.

Continuing with fuel vapor control system 50 shown in FIG. 2, vapor flow rate controller 110 is shown in this example including pulse width modulator 130, such as an off-the-shelf chip sold by National Semiconductor (Part No. LM3524), responsive to multiplier 132 for generating signal pwm in response to airflow measurement MAF. More specifically, multiplier 132 multiplies measurement of mass airflow MAF by proportionality constant $K_p$. This proportionality constant is equal to the ratio of desired vapor flow (cu. ft./min.) to mass airflow. Accordingly, signal pwm has a duty cycle directly related to desired vapor flow which in turn is a fixed proportion ($K_p$) of mass airflow. As previously described herein, it is desirable to maintain vapor flow as a proportion of inducted airflow to reduce any air/fuel transients from air/fuel feedback control system 44 which would otherwise occur such as during sudden changes in mass airflow. Further, by maintaining vapor flow as a proportion of inducted airflow, the range of authority of air/fuel feedback control system 44 will not be exceed when rich fuel vapors are inducted.

Figure 3A:
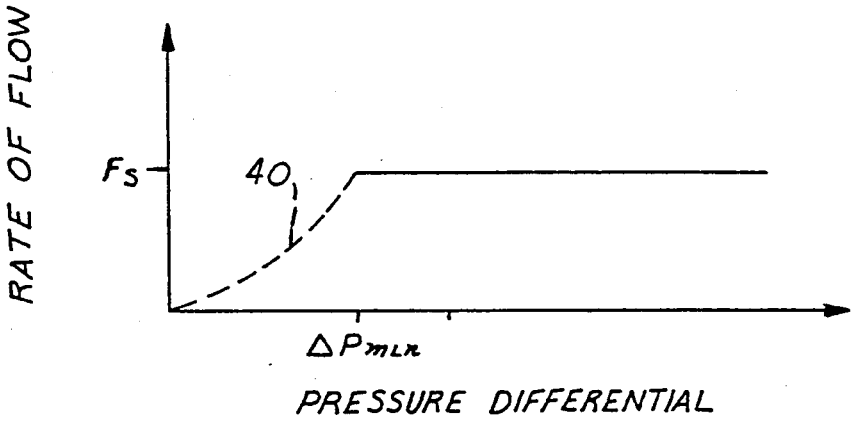
FIG. 3A is a graphical representation of the rate of vapor flow versus pressure differential across a valve controlling vapor flow which illustrates the advantage of sonic vapor flow.
Figure 3B:
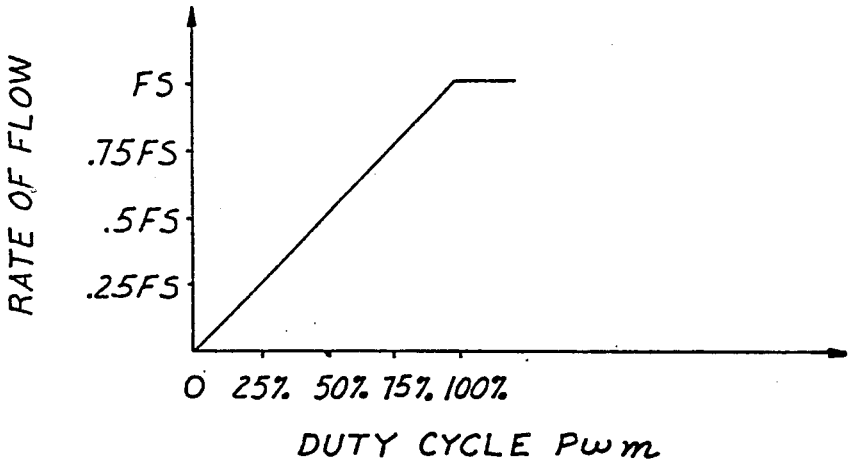
FIG. 3B is a graphical illustration of vapor flow through a solenoid valve as a function of actuating pulse width during sonic flow conditions.

The operation of fuel vapor control system 50 in controlling vapor flow is shown graphically in FIGS. 3A and 3B. Referring first to FIG. 3A, it is seen that by maintaining the pressure differential across valve 90 at a value greater than $\Delta P_{min}$, flow through valve 90 is always sonic ($F_s$). Stated another way, vapor flow is a constant value $F_s$ which does not vary with manifold pressure during actuation of valve 90. On the other hand, in prior approaches, flow varied with changes in pressure below $\Delta P_{min}$ which is represented by dashed line 140 in FIG. 3A.

It is noted that by maintaining inlet pressure to valve 90 at a multiple of the maximum achievable manifold pressure, the pressure differential across valve 90 is always greater than $\Delta P_{min}$ regardless of engine operation. Those skilled in the art will recognize that there are other similar schemes which may be used to achieve sonic vapor flow. For example, a differential pressure transducer positioned across valve 90 may be utilized to actuate pump 74 such that the pressure differential is directly adjusted to be greater than $\Delta P_{min}$.

Since flow through valve 90 is made essentially sonic by operation of the pressure regulating scheme described above, vapor induction into engine 12 is controlled in a precise fashion by modulating the "on" time of purge valve 90. Vapor flow through valve 90 is therefore linearly proportional to the duty cycle of signal pwm as shown in FIG. 3B. Accordingly, vapor flow is precisely controlled and, unlike prior approaches, is independent of fluctuations in engine manifold pressure.

Figure 4A:
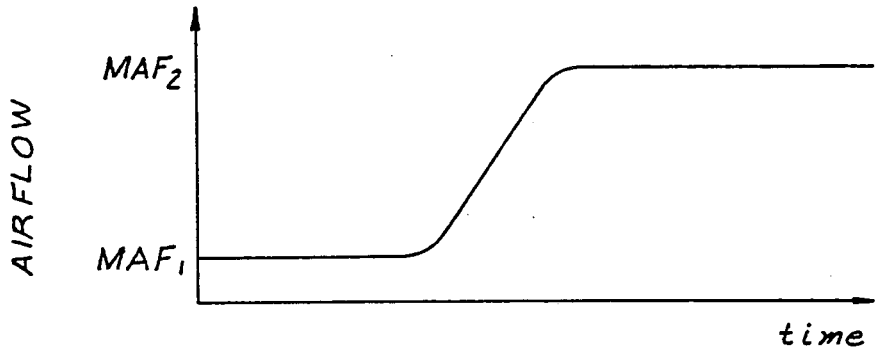
FIG. 4A is a graphical illustration of an example of operation wherein inducted airflow is abruptly changed.
Figure 4B:
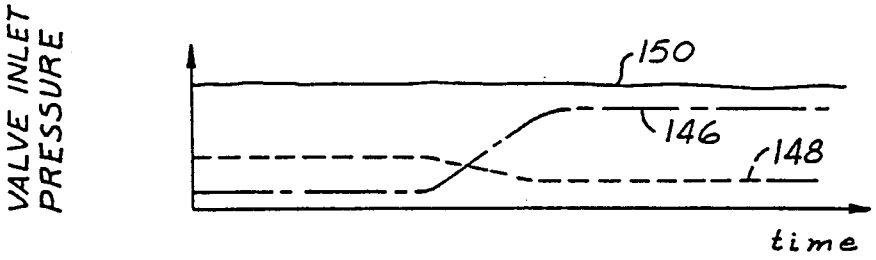
FIG. 4B is a graphical illustration of inlet pressure to the purge control valve and engine manifold pressure correlated with the operation shown in FIG. 4A.

Referring now to FIGS. 4A–4E, a hypothetical example of operation is presented. In this particular example, airflow is shown abruptly changing from $MAF_1$ to $MAF_2$ in response to an abrupt change in throttle position (see FIG. 4A). As shown in FIG. 4B, manifold pressure (line 146) is shown increasing in correspondence to the change in airflow (i.e., manifold vacuum decreases as throttle position abruptly increases). It is noted that without operation of fuel vapor control system 50, valve inlet pressure would fall as shown by line 148 in response to the increase in manifold pressure. However, fuel vapor control system 50 maintains valve inlet pressure at a relatively constant value ($P_{Ref}$) as shown by line 150, thereby providing sonic vapor flow.

Figure 4C:
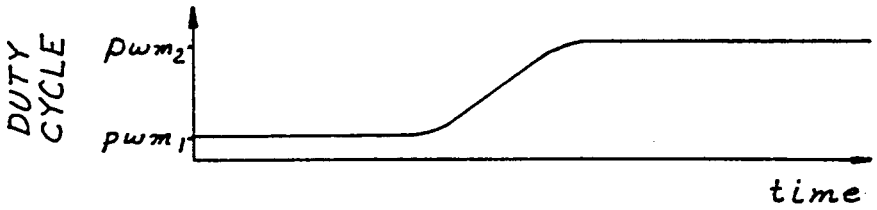
FIG. 4C is a graphical illustration of changes in the actuating signal to the purge control valve correlated with the operation shown in FIG. 4A.
Figure 4D:
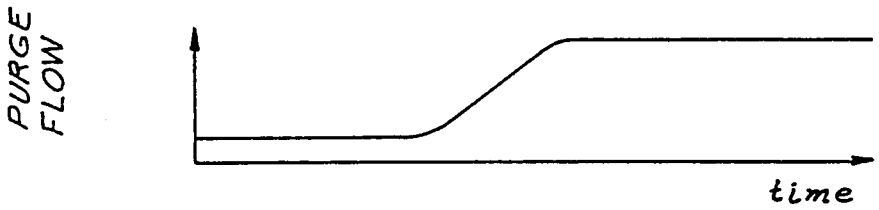
FIG. 4D is a graphical illustration of actual inducted vapor flow correlated with the operation shown in FIGS. 4A and 4B.
Figure 4E:
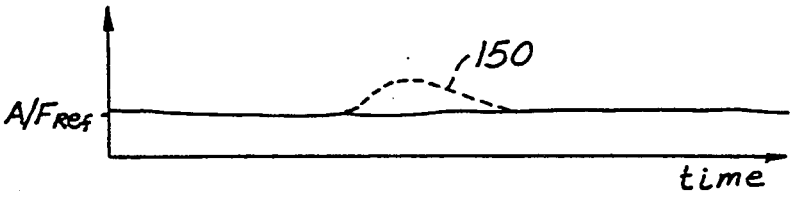
FIG. 4E is a graphical illustration of air/fuel ratio correlated with the operation depicted in FIGS. 4A–4D.

Referring to FIG. 4C, purge rate controller 110 appropriately alters the duty cycle of signal pwm from $pwm_1$ to $pwm_2$ such that signal pwm remains proportional to signal MAF. Since vapor flow is sonic, the inducted vapor flow through valve 90 is linearly proportional to the duty cycle of signal pwm and accordingly linearly proportional to inducted airflow as shown in FIG. 4D. In response to this linear proportionality, air/fuel feedback control system 44 is able to maintain air/fuel ratio at $A/F_{Ref}$ as shown in FIG. 4E. Without operation of fuel vapor recovery system 50, there would be a transient in air/fuel ratio as shown by dashed line 150 in FIG. 4E.

Figure 5:
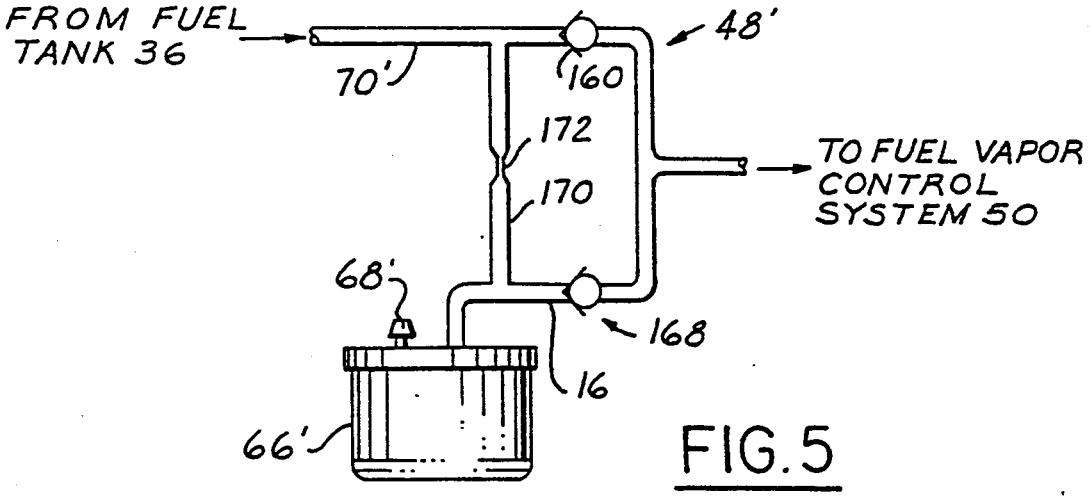
FIG. 5 is an alternate embodiment of the fuel vapor recovery system shown in FIG. 2.

An alternate embodiment of fuel vapor recovery system 48' is shown in FIG. 5 wherein like numerals refer to like parts shown in FIG. 2. Fuel tank 36 (FIG. 2) is shown coupled to fuel vapor control system 50 via vapor line 70' and check valve 160'. Vapor recovery canister 66' is shown coupled in parallel with fuel tank 36 to fuel vapor control system 50 via vapor line 164 and check valve 168. Vapor bleed line 170 having restriction 172 formed therein is shown communicating between vapor line 70' and vapor line 164. When engine 12 is shut off and fuel vapor control system 50 is inoperative, fuel vapors from tank 36 flow through canister 66' and out atmospheric vent 68' via vapor bleed line 170. During engine operation, when fuel vapor control 50 is operative, vapors from canister 66' and vapor from fuel tank 70' enter fuel vapor control system 50 via two parallel paths. Accordingly, the proportional contribution of fuel vapors by both canister 66' and fuel tank 36 is essentially constant during short time intervals. This configuration thereby reduces air/fuel transients which might otherwise occur when a single vapor line is used for both fuel tank 36 and canister 66. For example, when fuel tank 36 is under high vapor pressure, fuel vapors might otherwise flow directly into canister 66 such that purging from canister 66 might otherwise be inhibited. The embodiment shown in FIG. 5 avoids these and other problems inherent in using a single vapor line for both fuel tank 36 and canister 66.

This concludes the description of the preferred embodiment. The reading of it by those skilled in the art will bring to mind many alterations and modifications without departing from the spirit and scope of the invention claimed herein. For example, numerous pressure regulations schemes may be utilized to provide sonic vapor flow through solenoid valve 90. Accordingly, it is intended that the scope of the invention be limited only by the following claims.

What is claimed:

1. A control system for an internal combustion engine having an air/fuel intake system coupled to a fuel system, comprising:

fuel vapor recovery means coupled to the fuel system for receiving fuel vapors;

an electronically actuated solenoid valve coupled between said fuel vapor recovery means and the air/fuel intake system for controlling flow rate of said vapors into the air/fuel intake system; and regulating means for providing a minimal pressure differential across said valve greater than a critical pressure required to achieve substantially sonic flow through said valve such that flow through said valve is substantially independent of pressure variations in the air/fuel intake system.

2. The control system recited in claim 1 wherein said fuel vapor recovery system comprises a vapor storage canister coupled to a fuel tank.

3. The control system recited in claim 1 wherein said regulating means comprises an electrical pump responsive to a pressure measurement at an inlet of said valve.

4. A control system for an internal combustion engine having an air/fuel intake system coupled to a fuel system, comprising:

fuel vapor recovery means coupled to the fuel system for receiving fuel vapors;

control means for providing a desired rate of vapor flow signal;

an electronically actuated solenoid valve responsive to said desired rate of vapor flow signal and coupled between said fuel vapor recovery means and the air/fuel intake system for controlling actual rate of vapor flow; and regulating means for regulating pressure differential across said valve to maintain said pressure differential above a critical pressure associated with sonic flow to achieve substantially sonic vapor flow through said valve such that said actual rate of vapor flow is linearly proportional to said desire rate of vapor flow signal.

5. The control system recited in claim 4 wherein said regulating means is responsive to at least a pressure measurement at an inlet of said valve.

6. The control system recited in claim 4 wherein said regulating means comprises a comparison of inlet pressure at said valve with a reference pressure.

7. The control system recited in claim 4 wherein said control means provides said desired rate of flow signal having a duty cycle proportioned to desired rate of flow.

8. A control system for an internal combustion engine having an air/fuel intake system coupled to a fuel system, comprising:

fuel vapor recovery means coupled to the fuel system for receiving fuel vapors;

control means for providing a desired rate of vapor flow command;

an electronically actuated solenoid valve responsive to said desired rate of vapor flow command and having an inlet coupled to said fuel vapor recovery means and an outlet coupled to the air/fuel intake system for controlling actual rate of vapor flow;

an electric pump coupled between said fuel vapor recovery means and said valve inlet; and regulating means for applying electric power to said pump in response to a measurement of pressure at said inlet valve to achieve substantially sonic flow through said valve such that said actual rate of fuel vapor flow is linearly proportional to said desired rate of vapor flow command.

9. The control system recited in claim 8 further comprising a reservoir coupled between said pump and said valve inlet.

10. The control system recited in claim 8 wherein said regulating means comprises a pressure transducer for providing said measurement of pressure.

11. A control system for an internal combustion engine having an air/fuel intake system for inducting an air/fuel mixture and fuel from a fuel system, comprising:

fuel vapor recovery means coupled to the fuel system for receiving fuel vapors;

control means for providing a desired rate of vapor flow command in relation to a calculation of inducted airflow;

air/fuel ratio feedback control means responsive to both the calculation of inducted airflow and feedback from an exhaust gas oxygen sensor for regulating fuel inducted into the air/fuel intake system to achieve a desired air/fuel ratio of a mixture of air and fuel and fuel vapor inducted into the air/fuel intake system;

an electronically actuated solenoid valve responsive to said desired rate of vapor flow command and coupled between said fuel vapor recovery means and the air/fuel intake system for controlling actual rate of vapor flow; and regulating means for regulating pressure differential across said valve above a critical pressure to achieve substantially sonic vapor flow through said valve such that said actual rate of vapor flow is linearly proportional to said desired rate of vapor flow command.

12. The control system recited in claim 11 wherein said regulating means is responsive to a comparison of pressure at an inlet of said valve to a reference pressure.

13. The control system recited in claim 11 wherein said regulating means is responsive to a comparison of pressure at an inlet of said valve to a value associated with pressure in said air/fuel intake system.

14. A control system for an internal combustion engine having an air/fuel intake system for inducting an air/fuel mixture and fuel from a fuel system, comprising:

a fuel tank and a first vapor line coupled between said fuel tank and a vapor control system;

a vapor storage canister coupled to said fuel tank via a vapor bleed line, said vapor storage canister being coupled directly to said vapor control system via a second vapor line; and said vapor control system comprising a solenoid valve and pressure regulating means for regulating pressure differential across said valve such that vapor flow through said valve is linearly proportional to inducted airflow and vapor flow through said first vapor line is proportional to flow through said second vapor line.

15. The control system recited in claim 14 further comprising a first valve coupled to said first vapor line and a second valve coupled to said second vapor line.

16. A method for controlling rate of fuel vapor flow from a fuel vapor recovery system to an air/fuel intake system of an internal combustion engine via an electronically activated valve, comprising the steps of:

providing an electrical signal to the valve having a duty cycle proportional to a desired rate of vapor flow;

providing an indication of inlet pressure at said valve; and regulating said inlet pressure to achieve a pressure differential across the valve above a critical pressure associated with sonic vapor flow such that rate of vapor flow through the valve is linearly proportional to duty cycle of said electrical signal.

17. The method recited in claim 16 wherein said regulating step is responsive to a comparison of said inlet pressure with a reference pressure.

18. The method recited in claim 16 wherein said electrical signal providing means is responsive to a measurement of airflow inducted into the air/fuel intake system.

* * * * *